US011384916B2

(12) United States Patent
Guerrero et al.

(10) Patent No.: US 11,384,916 B2
(45) Date of Patent: Jul. 12, 2022

(54) LENS HOLDER FOR HOLDING A LENS IN A HEADLAMP

(71) Applicant: HELLA GmbH & Co. KGaA, Lippstadt (DE)

(72) Inventors: Domingo Guerrero, Paderborn (DE); Christian Koerdt, Geseke (DE); Andreas Meyer, Lippstadt (DE)

(73) Assignee: Hella GmbH & Co. KGaA, Lippstadt (DE)

( * ) Notice: Subject to any disclaimer, the term of this patent is extended or adjusted under 35 U.S.C. 154(b) by 0 days.

(21) Appl. No.: 17/353,097

(22) Filed: Jun. 21, 2021

(65) Prior Publication Data

US 2021/0310629 A1 Oct. 7, 2021

Related U.S. Application Data

(63) Continuation of application No. PCT/EP2019/084218, filed on Dec. 9, 2019.

(30) Foreign Application Priority Data

Dec. 20, 2018 (DE) ..... 10 2018 133 061.8

(51) Int. Cl.
*F21S 41/29* (2018.01)
*F21S 41/25* (2018.01)

(52) U.S. Cl.
CPC ..... *F21S 41/29* (2018.01); *F21S 41/25* (2018.01)

(58) Field of Classification Search
None
See application file for complete search history.

(56) References Cited

U.S. PATENT DOCUMENTS

| | | | | |
|---|---|---|---|---|
| 3,539,799 | A | 11/1970 | Dangauthier | |
| 8,439,544 | B2 | 5/2013 | Seiger | |
| 2012/0307511 | A1 | 12/2012 | Cheng | |
| 2015/0285455 | A1* | 10/2015 | Sudahl | F21S 41/29 362/520 |
| 2015/0377440 | A1* | 12/2015 | Reitegger | F21S 41/25 362/520 |
| 2017/0321860 | A1 | 11/2017 | Wu | |

FOREIGN PATENT DOCUMENTS

| | | | |
|---|---|---|---|
| CN | 105570838 | B | 9/2018 |
| DE | 10 2007 052 985 | A1 | 5/2009 |
| DE | 10 2008 027 721 | A1 | 12/2009 |
| DE | 10 2017 105 757 | A1 | 11/2017 |
| DE | 10 2017 223 149 | B3 | 9/2018 |
| EP | 2 133 721 | A1 | 12/2009 |
| EP | 2 279 907 | A1 | 2/2011 |
| EP | 2 306 077 | A2 | 4/2011 |
| FR | 3 056 700 | A1 | 3/2018 |
| KR | 10-2016-0077724 | A | 7/2016 |

* cited by examiner

*Primary Examiner* — Elmito Breval
(74) *Attorney, Agent, or Firm* — Muncy, Geissler, Olds & Lowe, P.C.

(57) ABSTRACT

A lens holder for holding a lens in a headlamp, and to a headlamp having such a lens holder, wherein the lens holder comprises a receptacle section for holding the lens and a mounting section, wherein the mounting section can be mounted in the headlamp by means of fasteners. The lens holder has an at least partially circumferential channel between the receptacle section and the mounting section.

10 Claims, 3 Drawing Sheets

LENS HOLDER FOR HOLDING A LENS IN A HEADLAMP

This nonprovisional application is a continuation of International Application No. PCT/EP2019/084218, which was filed on Dec. 9, 2019, and which claims priority to German Patent Application No. 10 2018 133 061.8, which was filed in Germany on Dec. 20, 2018 and which are both herein incorporated by reference.

BACKGROUND OF THE INVENTION

Field of the Invention

The present invention relates to a lens holder for holding a lens in a headlamp, wherein the lens holder comprises a receptacle section for holding the lens and a mounting section, wherein the mounting section can be mounted in the headlamp by means of fasteners.

Description of the Background Art

Headlamps for motor vehicles are sufficiently known from the prior art. Modern projection headlamps include, as essential components, a light source, in particular xenon gas-discharge lamps or light-emitting diodes (LEDs), optionally a reflector enclosing the light source at the rear, a lens arranged in front of the light source by means of a lens holder, a cover plate at the front, and a supporting frame that serves to hold the aforementioned components and to connect to the vehicle body. The lens holder includes a receptacle section for holding the lens and a mounting section for connecting to the supporting frame or to a heat sink or to another optical component, usually by means of screw connections.

A general problem of projection headlamps is in that the different components, which usually are made of different materials, expand to different degrees on account of their material-specific coefficients of thermal expansion when changes occur in the operating and/or ambient temperature of the headlamps. In particular, this causes a temperature-dependent shift between the light source and the lens and/or a displacement of the optical axis of the headlamp, wherein the extent of these effects usually does not change in a reversible, linear manner with the temperature, but instead more complex dependencies occur, in particular irreversible and/or hysteretic shifts and/or displacements. Corresponding shifts and/or tilting of the light cone projected onto the roadway and/or reductions of the light intensity transmitted by the lens and/or other undesirable aberrations result from such shifts between light source and lens.

In order to compensate for such temperature-dependent impairment of the headlamp functionality, EP 2 306 077 A2 proposes arranging the lens mount such that the distance on the optical axis between the light exit surface of the light source and the light entry surface of the lens is adjusted to a setpoint value as a function of a temperature change occurring in the headlamp as a result of a separate, thermally caused change in length of the lens mount.

A disadvantage of this prior art device is the limitation of the shift correction to shifts between the light source and the lens along the optical axis, whereas no allowance is made for shifts and/or displacements oriented radially to the optical axis. However, even the smallest shifts in the plane perpendicular to the vertical axis lead to a clearly visible shift in the light/dark boundary on the roadway, which can then bring about dangerous glare for oncoming traffic, for example.

Such radial shifts occur particularly in headlamps in which the supporting frame and the lens holder screwed thereto are made of different materials, which is normally the case in prior art headlamps. Thus, lens holders are made of a polycarbonate, for example, which is suitable for connection to the lens by laser welding, whereas the supporting frame is fabricated from a mechanically more robust fiber-matrix semifinished product with greater load capacity, for example. The two components are usually screwed directly to one another, for instance by means of four screws, and if the assembly experiences a temperature change, with a temperature range of approximately −40° C. to +100° C. being relevant in practice, then each component is compelled to expand in accordance with its particular coefficient of thermal expansion. The coefficient of thermal expansion is approximately $60\times10^{-6}$/K for polycarbonate and approximately $20\times10^{-6}$/K for a typically employed fiber-matrix semifinished material. The lens holder and supporting frame thus expand to varying degrees, and the fixed screw connection between them represents a constraint here for the expansion capability, by which means forces transverse to the screw direction are introduced into the components. After one or more temperature cycles, this causes irreversible deformations of one or both components to occur, resulting in irreversible changes in the light cone projected onto the roadway, in particular displacements of the light/dark boundary.

The same problems also arise in designs of headlamps in which the lens holder is connected to a heat sink or to another optical component. Even when the lens holder is mounted on a component made of the same material as the lens holder, irreversible distortion of the lens holder due to temperature change can occur, since temperature gradients that can develop along the optical axis of the headlamp, in particular, lead to local differences in the amount of thermal expansion of the components of the headlamp.

SUMMARY OF THE INVENTION

It is therefore an object of the present invention to overcome the above-described disadvantages of prior art headlamps, and therefore to propose an improvement of a headlamp whose functionality has greater robustness to temperature influences, i.e. its light cone projected onto the roadway is not subject to any shifting and/or tilting when the operating and/or ambient temperature of the headlamp changes.

In an exemplary embodiment, a lens holder has an at least partially circumferential channel between the receptacle section and the mounting section.

The invention is based here on the concept of creating a thermomechanical decoupling of the receptacle section and the mounting section in the design in that the thermomechanical distortion arising between the two sections is absorbed and compensated by a suitable bending of the circumferential channel between the two sections. In the event of a temperature change of the headlamp, the receptacle section of the lens holder expands or contracts to a different extent than the mounting section because the latter is fixed to the supporting frame in the plane of the screw, and the supporting frame has a different thermal expansion capability on account of the different materials. The channel according to the invention preferably has a U-shaped or arched cross-section, wherein one end section of the arch meets the mounting section and the other end section leads to the receptacle section. The channel reacts to the described unequal thermal expansion of the mounting and receptacle sections with a change in cross-section that is essentially characterized by a change in the curvature of the arch. The channel thus clearly takes on the function of a buffer, which is to say that because the two end sections of the arched cross-section each follow the thermally induced deformation of the mounting section and the receptacle section, the channel is changed in terms of its curvature and thus absorbs the transverse forces acting between the screwed-on mounting section and the receptacle section. As a result of such a thermomechanical decoupling between the mounting and receptacle sections, the lateral shear forces under the screw heads in the screw plane of the mounting section adjacent to the supporting frame caused by thermal expansion are greatly reduced so that the clamping forces transmitted by the screws are large enough to prevent irreversible deformation of the lens holder and/or supporting frame.

The channel can also have the shape of a groove. In particular, the shape of the cross-section of the channel can vary in the circumferential direction of the channel.

In an advantageous embodiment of the lens holder according to the invention, the receptacle section can be designed as a tubular hollow body with openings at the ends, wherein a longitudinal axis of the hollow body is defined and the longitudinal axis passes perpendicularly through the openings at the ends, wherein a transition section adjoins the receptacle section axially with respect to the longitudinal axis, wherein the mounting section adjoins the transition section axially with respect to the longitudinal axis, and the channel extends radially around the transition section with respect to the longitudinal axis. The longitudinal axis in this design passes through the geometric centroid of the receptacle section and corresponds essentially to the optical axis of the headlamp. The light source is arranged behind the mounting section of the lens holder and radiates into the rear end opening of the receptacle section. The contour of the receptacle section is determined by the lens contour, and sun guards or additional design elements may, if applicable, also be installed in the tube. The cover plate of the headlamp is arranged in front of the front end opening of the receptacle section.

Preferably, the lens holder has a multiplicity of ribs, wherein the ribs are arranged on the lens holder on the outside and/or on the inside and in each case extend essentially axially along the mounting section and the transition section and the receptacle section with respect to the longitudinal axis. Such longitudinal ribs provide stiffening between the screw-attachment plane and the lens plane in order to ensure load transmission into the supporting frame and consequently adequate mechanical stability for use in vehicle operation. The longitudinal ribs in this design are dimensioned and arranged such that their presence is not accompanied by any significant bridging or stiffening of the channel according to the invention.

The dimensioning of the channel according to the invention is preferably chosen as follows. The receptacle section has an average radius with respect to the longitudinal axis passing through the geometric centroid of the receptacle section, and the channel has an average depth, wherein the average depth of the channel is 0.1 times to 0.5 times, preferably 0.3 times, the average radius of the receptacle section.

In an embodiment of the lens holder according to the invention, the channel can have at least a first section and a second section, wherein the first section and the second section are arranged on opposite sides of the lens holder. Under some circumstances, it may be necessary for design reasons to dispense with a channel that extends around the full circumference, and instead to provide only two opposing sections of the lens holder with a channel. In this case, the thermomechanical decoupling of the receptacle section and the mounting section accordingly does not take place in all transverse directions. With regard to the arrangement of the headlamp in a motor vehicle, preferably the upper and lower sides of the lens holder are provided with a channel so that at least a thermal-expansion-induced upward and/or downward shifting of the light cone projected onto the roadway is prevented.

Preferably, the lens holder according to the invention can be manufactured by an injection molding process. The use of a slide mold is typically necessary for forming the channel in this case.

The subject matter of the invention is additionally a headlamp comprising a supporting frame and a lens holder for holding a lens, wherein the lens holder is implemented in one of the aforementioned embodiments.

Preferably, the headlamp includes a supporting frame, wherein the mounting section of the lens holder is connected to the supporting frame, and wherein the supporting frame is manufactured from a fiber-matrix semifinished product (bulk molding compound) and the lens holder (100) is manufactured from polycarbonate. Polycarbonate is suitable for laser welding, so this process can be used for joining the lens holder to the lens.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1A:
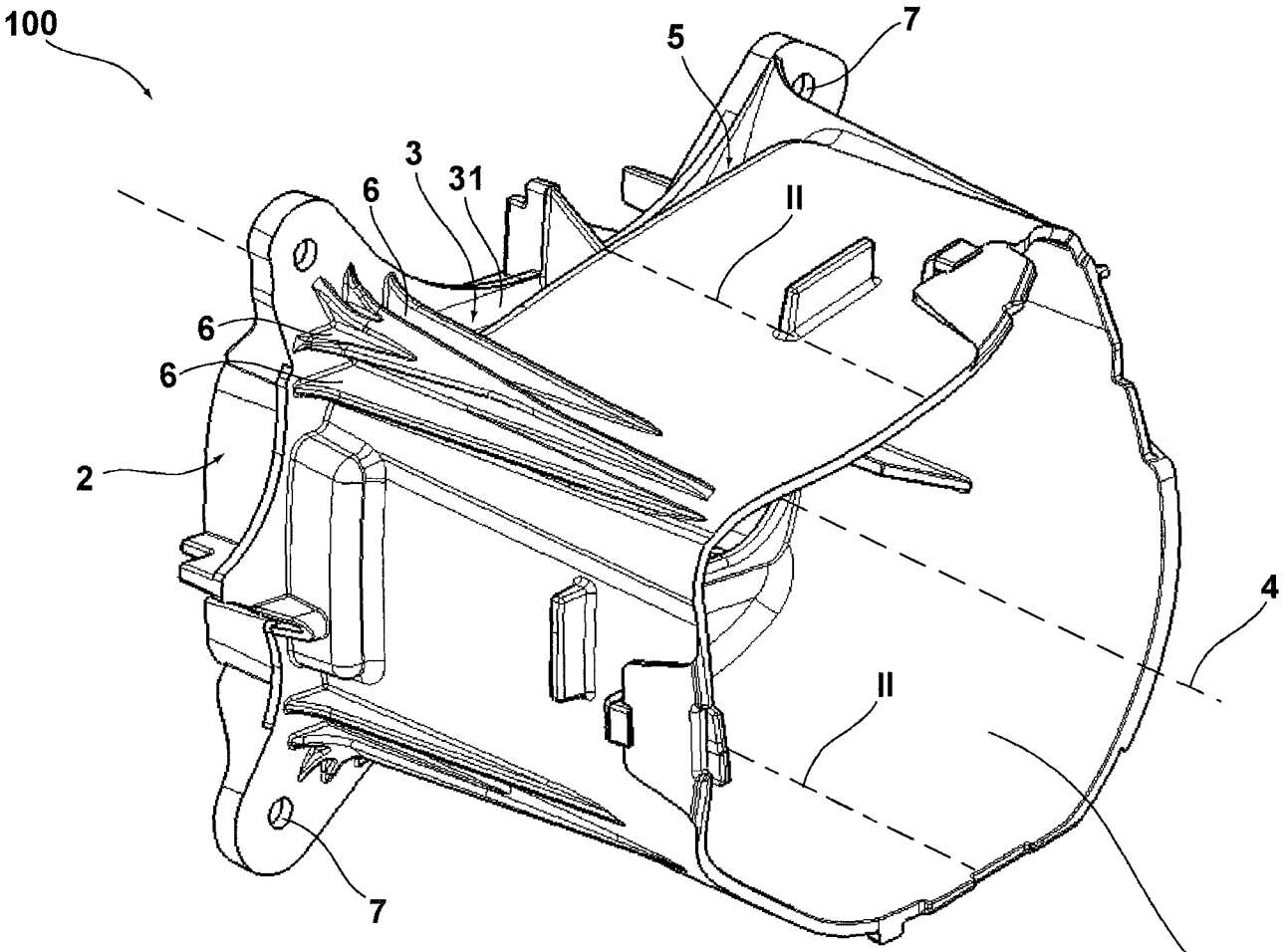
FIG. 1*a* is a first schematic representation of an embodiment of the lens holder according to the invention.
Figure 1B:
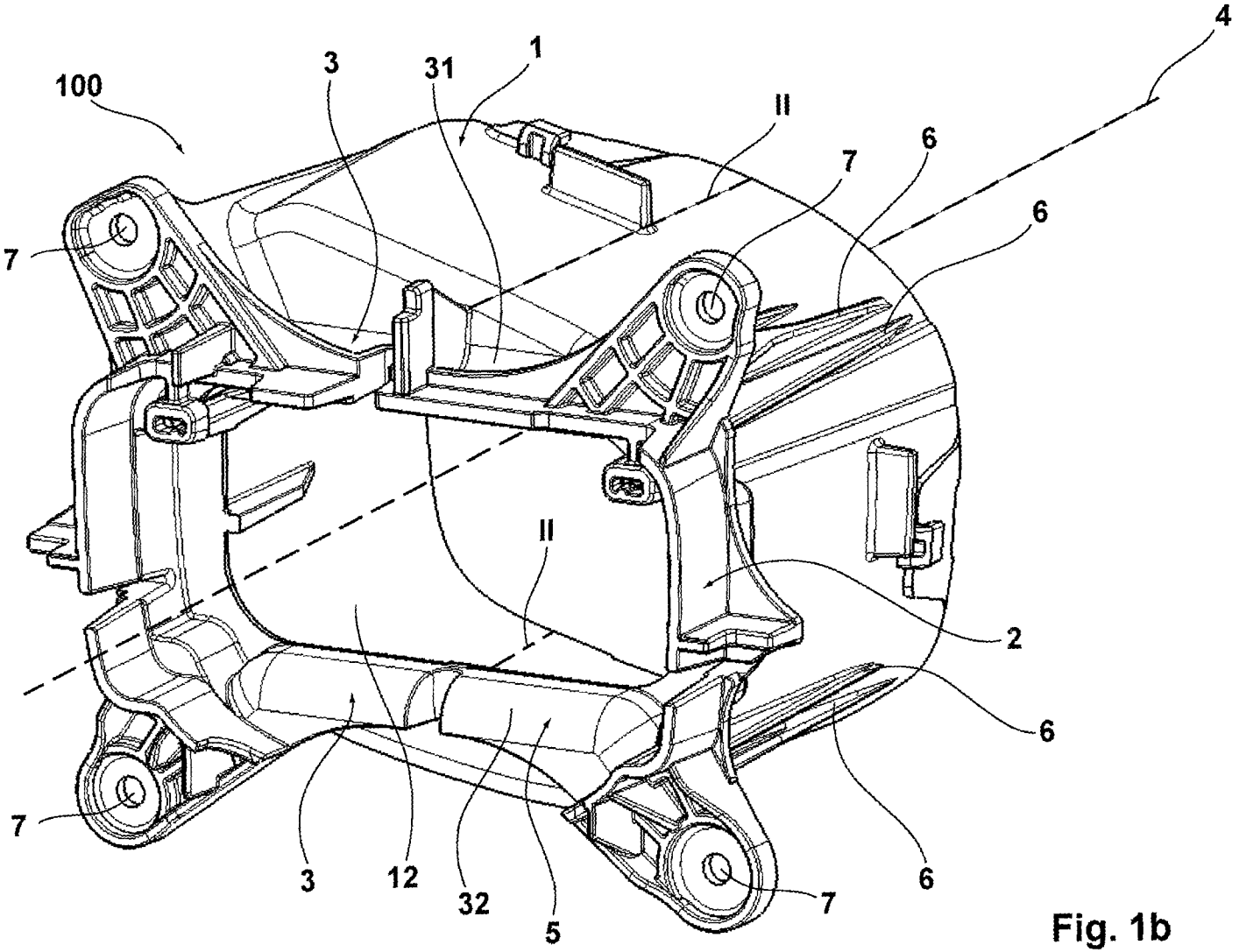
FIG. 1*b* is a second schematic representation of the embodiment.
Figure 2:
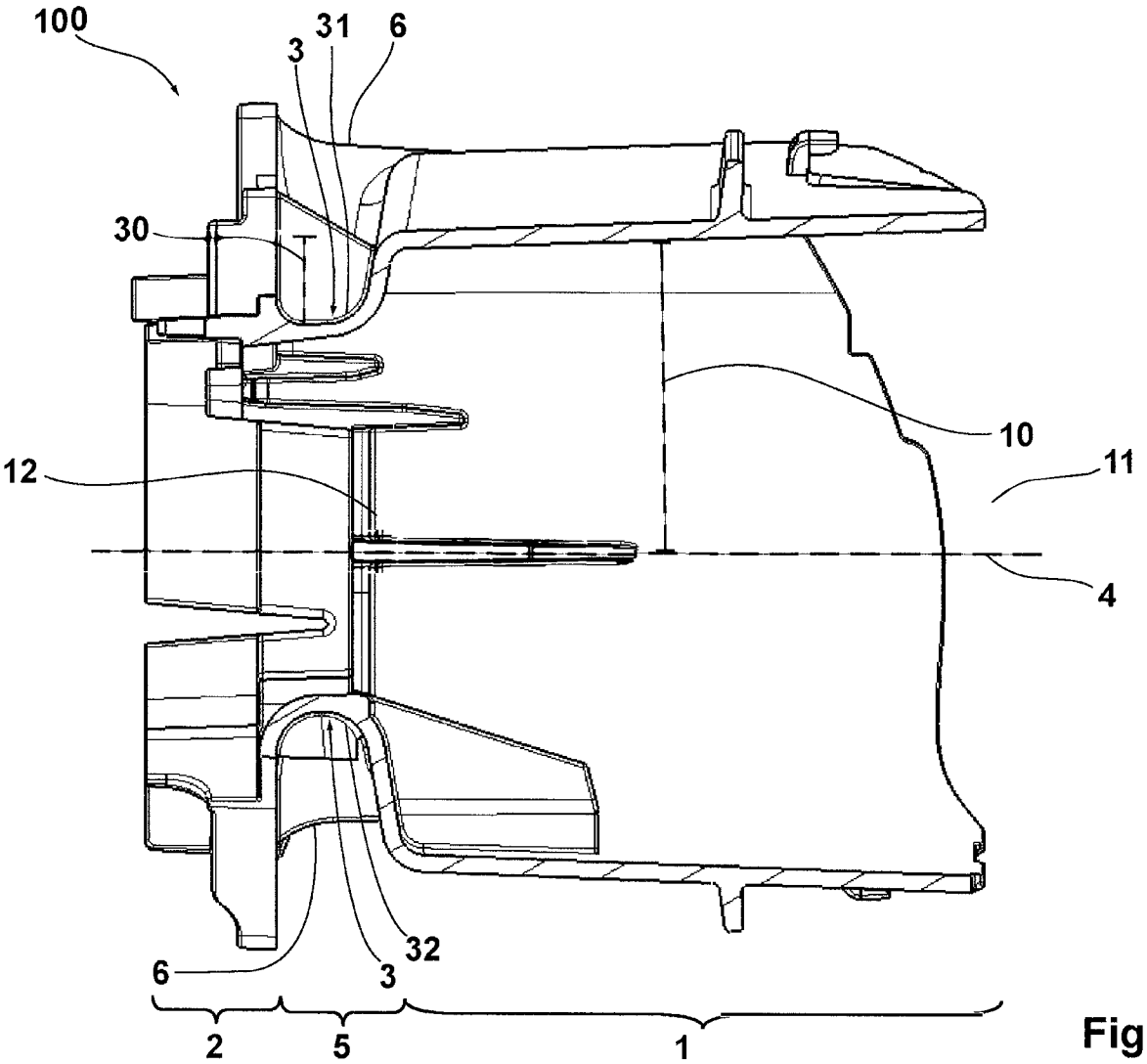
FIG. 2 is a cross-sectional representation of the embodiment.

FIGS. 1*a*, 1*b*, and 2 show an advantageous embodiment of the lens holder 100 according to the invention, with a receptacle section 1, formed by a tubular hollow body, for holding a lens, with a mounting section 2 provided for connecting to the supporting frame, and with a transition section 5 that is arranged between the receptacle section 1 and the mounting section 2 and is partially surrounded by the channel 3 according to the invention. The longitudinal axis 4 passes through the geometric centroid of the lens holder 100 and forms the normal of the plane of the openings 11, 12 at the ends of the receptacle section 1. The screw openings 7 arranged on the mounting section 2 are used for the screw connection of the lens holder 100 to the supporting frame of a headlamp. The light source of the headlamp in this case is arranged relative to the lens holder 100 in such a way that the emitted light enters through the rear opening 12 of the receptacle section 1, then passes through a lens held in the receptacle section 1, and subsequently emerges from the front opening 11 of the receptacle section 1.

When changes occur in the operating and/or ambient temperature of the lens holder 100 in a headlamp, the thermal expansion capability of the mounting section 2 is limited by the screw connection to the supporting frame of the headlamp, which usually is made of a different material than the lens holder 100. In order to avoid irreversible deformations and permanent distortion of the mounting section 2 in this case, according to the invention a thermomechanical decoupling from the receptacle section 1, which thermally expands freely, is carried out. This decoupling is realized by the intermediate transition section 5 with the partially circumferential channel 3. In FIG. 2, which shows a sectional view along the section lines II drawn in FIGS. 1*a* and 1*b*, the channel 3 is shown as an arched structure in the hatched section plane. The legs of the channel 3 connecting to the adjacent sections, which is to say to the receptacle section 1 and the mounting section 2, are each expanded according to the thermal expansion of the adjacent sections when temperature changes occur. Unequally large expansions of the receptacle section and the mounting section thus result in a deformation of the transition section 5, in particular in a change in the curvature of the channel 3, but not in an irreversible distortion of the lens holder 100, in particular of the mounting section 2 in the region of the screw connection to the supporting frame. Owing to this thermomechanical decoupling according to the invention of the receptacle section 1 and mounting section 2, the lens holder 100 is substantially more robust to repeated temperature changes as compared with prior art lens holders, which is to say that no distortion of the lens holder 100 that degrades the functionality of the associated headlamp occurs even after a great many temperature change cycles.

In the embodiment of the lens holder 100 shown in FIGS. 1*a*, 1*b*, and 2, the channel 3 is implemented only in sections as a first section 31 and a second section 32 on opposite sides of the lens holder 100. This can serve, in particular, to ensure adequate mechanical stability and load capacity of the lens holder 100. The thermomechanical decoupling of the receptacle section 1 and mounting section 2 is thus not provided in all spatial directions. When the lens holder 100 is installed in a headlamp in a motor vehicle in such a manner that the longitudinal axis 4 is in the horizontal direction, then a thermomechanical decoupling is nonetheless provided in the vertical direction, which is to say, in particular, protection is provided against upward and downward displacements of the light cone projected onto the roadway. The ribs 6 formed on the lens holder 100 on the outside, which start at the mounting section 2 and extend along the mounting section 5 and the receptacle section 1, also serve to increase the load capacity of the lens holder 100. By means of these longitudinal ribs 6, loads can be transmitted into the supporting frame of the headlamp from the receptacle section 1.

In FIG. 2, the average radius 10 of the receptacle section 1 and the average depth 30 of the channel 3 are shown. The average radius 10 of the receptacle section 1 is defined as the average distance between the longitudinal axis and the wall of the receptacle section 1 in the form of a hollow body, and the average depth 30 of the channel 3 is defined as the average radial distance, with respect to the longitudinal axis 4, between the bottom of the channel 3 and the wall of the receptacle section 1 in the form of a hollow body at the transition to the transition section 5. The ratio of the average depth 30 of the channel 3 to the average radius 10 of the receptacle section 1 is preferably chosen such that the lens holder 100 has thermomechanical decoupling from the receptacle section 1 and the mounting section 2 that is adequate for the practical use of headlamps while at the same time ensuring adequate stability and load capacity.

The invention is not limited in its implementation to the preferred exemplary embodiment provided above. Instead, a number of variants are possible that make use of the described solution even in embodiments that are fundamentally different in nature. All features and/or advantages, including design details and spatial arrangements, that derive from the claims, the description, or the drawings, can be essential for the invention individually as well as in a wide variety of combinations.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A lens holder for holding a lens in a headlamp, the lens holder comprising:

a receptacle section to hold the lens;

a mounting section adapted to be mounted in the headlamp via at least one fastener; and an at least partially circumferential channel formed between the receptacle section and the mounting section, wherein the mounting section has screw openings in which the at least one fastener is inserted, wherein the receptacle section is a tubular hollow body with openings at each end, wherein a longitudinal axis of the hollow body is defined and the longitudinal axis passes perpendicularly through the openings at each end, wherein a transition section is provided that adjoins the mounting section and the receptacle section, the transition section being located between the mounting section and the receptacle section in an axial direction of the longitudinal axis, wherein the channel is provided in the transition section, the channel having a U-shaped and/or arched cross-section having a back wall, a front wall and a curved bottom connecting the back wall and the front wall, and wherein the back wall of the channel is a surface of the mounting section having the screw openings therein and the front wall of the channel is a surface of the receptacle section that opposes the surface of the mounting section having the screw openings therein.

2. The lens holder according to claim 1 wherein the channel extends radially around the transition section with respect to the longitudinal axis.

3. The lens holder according to claim 2, wherein the lens holder has a plurality of ribs, wherein the ribs are arranged on the lens holder on an outside and/or on an inside, and wherein the ribs each extend essentially axially along the mounting section, the transition section and the receptacle section with respect to the longitudinal axis.

4. The lens holder according to claim 1, wherein the receptacle section has an average radius with respect to the longitudinal axis, wherein the channel has an average depth, and wherein the average depth of the channel is 0.1 times to 0.5 times the average radius of the receptacle section.

5. The lens holder according to claim 4, wherein the average depth of the channel is 0.3 times the average radius of the receptacle section.

6. The lens holder according to claim 1, wherein the channel has a first section and a second section, wherein the first section and the second section are arranged on opposite sides of the lens holder.

7. The lens holder according to claim 1, wherein the lens holder is manufactured by an injection molding process.

8. A headlamp comprising:

a supporting frame; and a lens holder to hold a lens, wherein the lens holder comprises a receptacle section for holding the lens and a mounting section, wherein the mounting section is connected to the supporting frame by screws, and wherein the lens holder has an at least partially circumferential channel formed between the receptacle section and the mounting section, wherein the mounting section has screw openings in which the screws are inserted, wherein the receptacle section is a tubular hollow body with openings at each end, wherein a longitudinal axis of the hollow body is defined and the longitudinal axis passes perpendicularly through the openings at each end, wherein a transition section is provided that adjoins the mounting section and the receptacle section, the transition section being located between the mounting section and the receptacle section in an axial direction of the longitudinal axis, wherein the channel is provided in the transition section, the channel having a U-shaped and/or arched cross-section having a back wall, a front wall and a curved bottom connecting the back wall and the front wall, wherein the back wall of the channel is a surface of the mounting section having the screw openings therein and the front wall of the channel is a surface of the receptacle section that opposes the surface of the mounting section having the screw openings therein.

9. The headlamp according to claim 8, wherein the channel extends radially around the transition section with respect to the longitudinal axis.

10. The headlamp according to claim 8, wherein the supporting frame is manufactured from a fiber-matrix semi-finished product and the lens holder is manufactured from polycarbonate.

* * * * *